US006059639A

United States Patent [19]

Kuehn et al.

[11] Patent Number: 6,059,639

[45] Date of Patent: May 9, 2000

[54] SHOT BLAST MACHINE WITH IMPROVED TUMBLING CAPABILITIES

[75] Inventors: Udo Kuehn, Holland, Ohio; Dwight E. Lutsko, Adrian, Mich.

[73] Assignee: B&U Corporation, Adrian, Mich.

[21] Appl. No.: 09/260,530

[22] Filed: Feb. 26, 1999

[51] Int. Cl.[7] ..... B24C 3/14

[52] U.S. Cl. ..... 451/75; 451/85; 451/328

[58] Field of Search ..... 451/81, 85, 86, 451/89, 75, 34, 328

[56] References Cited

U.S. PATENT DOCUMENTS

| | | | |
|---|---|---|---|
| 1,882,443 | 10/1932 | Pelk | 451/85 X |
| 2,574,867 | 11/1951 | Gladfelter | 451/86 |
| 3,585,758 | 6/1971 | Harper | 451/85 |
| 3,690,068 | 9/1972 | Coss et al. | 451/89 X |
| 4,218,854 | 8/1980 | Hunziker | 451/86 |

*Primary Examiner*—David A. Scherbel
*Assistant Examiner*—Anthony Ojini
*Attorney, Agent, or Firm*—Harness, Dickey & Pierce, P.L.C.

[57] ABSTRACT

A shot blast machine for cleaning workpieces that includes two tumbler sections and at least one blast wheel for impelling abrasive particles. Both tumbler sections have a surface with an ingress and an egress for supporting and tumbling the workpieces under the path of abrasive particles. Though horizontally adjacent, the two surfaces are vertically displaced relative to each other. The vertical displacement of the surfaces forms a step to induce an additional tumble of the workpieces as they tumble from the egress of the first tumbler section to the ingress of the second tumbler section, thereby encouraging the shot blasting of every surface on the workpieces in a timely manner. The degree of tilt of the surfaces is selectively adjustable, thereby allowing substantial control over the duration of the cleaning cycle. Each tumbler section is formed from a flexible belt which is maintained in a desirable U-shape by a cylindrical drum which also creates a cantilever relation of the rotating drum and the moving belt.

4 Claims, 2 Drawing Sheets

SHOT BLAST MACHINE WITH IMPROVED TUMBLING CAPABILITIES

TECHNICAL FIELD OF THE INVENTION

This invention generally relates to shot blast machines for cleaning workpieces. More specifically, this invention relates to shot blast machines with improved tumbling capabilities.

BACKGROUND

Shot blasting is a cleaning process that removes sand, scale and other debris from workpieces, such as engine components or other articles, by impelling abrasive particles towards the workpieces. Although shot blasting has been used for many years, certain limitations and disadvantages of the shot blast machines of the conventional techniques in the art have not, until this time, been overcome. These limitations and disadvantages include the less-than-optimal efficiency of the cleaning process.

Less-than-optimal efficiency of the cleaning process typically occurs during the shot blasting of workpieces with uneven surfaces. In these situations, the workpieces must be tumbled in nearly dozens of different angles towards the path of abrasive particles. To assure proper cleaning of the workpieces, the shot blast machines of the conventional techniques in the art tumble the workpieces for an extended time, in hope that the workpieces are tumbled in the right direction. The extension of the cleaning cycle results in less-than-optimal efficiency of the cleaning process, however, and a better method for insuring the proper tumbling action is desired.

Less-than-optimal efficiency of the cleaning process also occurs because of the ineffective control over the production rate of the shot blast machine. The shot blast machines of the conventional techniques in the art include a belt configuration on a chain and slat system which are inclined or are equipped with pusher ridges to forward workpieces in a spiral motion. Also in use are systems that use a barrel for supporting and tumbling workpieces under the path of abrasive particles. These barrels are typically tilted relative to the horizontal, which allows the workpieces to tumble in a helical or spiral pattern from an ingress of the barrel to an egress. The duration of a cleaning cycle is hence defined as the time necessary for the workpieces to travel from ingress to egress. On most shot blast machines of the conventional techniques in the art, the duration of the cleaning process is difficult, if not impossible, to adjust. Since different workpieces may require a different duration, a better method of insuring the effective control over the duration is desired for an effective and efficient cleaning process.

SUMMARY OF THE INVENTION

Accordingly, this invention provides for a shot blast machine that overcomes the problems and disadvantages of the conventional techniques in the art. The present invention also provides for a shot blast machine with an increase in cleaning quality. Additionally, the present invention provides for a shot blast machine with an increase in cleaning efficiency.

Briefly, the invention is a shot blast machine for cleaning workpieces that includes two tumbler sections and at least one blast wheel for impelling abrasive particles. Both tumbler sections have a surface with an ingress and an egress for supporting and tumbling the workpieces under the path of abrasive particles. Though horizontally adjacent, the two surfaces are vertically displaced relative to each other. The vertical displacement of the surfaces forms a step to induce an additional tumble of the workpieces as they tumble from the egress of the first tumbler section to the ingress of the second tumbler section. This feature of the present invention encourages the shot blasting of every surface on the workpieces in a timely manner, thereby increasing the quality and the efficiency of the entire cleaning process. The second tumbler tumbles the workpieces in the opposite direction from the first tumbler to improve exposure of the workpieces to the shot. Additionally, the degree of tilt of the surfaces is selectively adjustable. This feature of the present invention allows substantial control over the duration of the cleaning cycle, thereby further increasing the efficiency of the shot blast machine.

Further features and advantages of the invention will become apparent from the following discussion and accompanying drawings.

DETAILED DESCRIPTION OF THE PREFERRED EMBODIMENT

The following description of the preferred embodiment is merely exemplary in nature, and is in no way intended to limit the invention or its application or uses.

Figure 1:
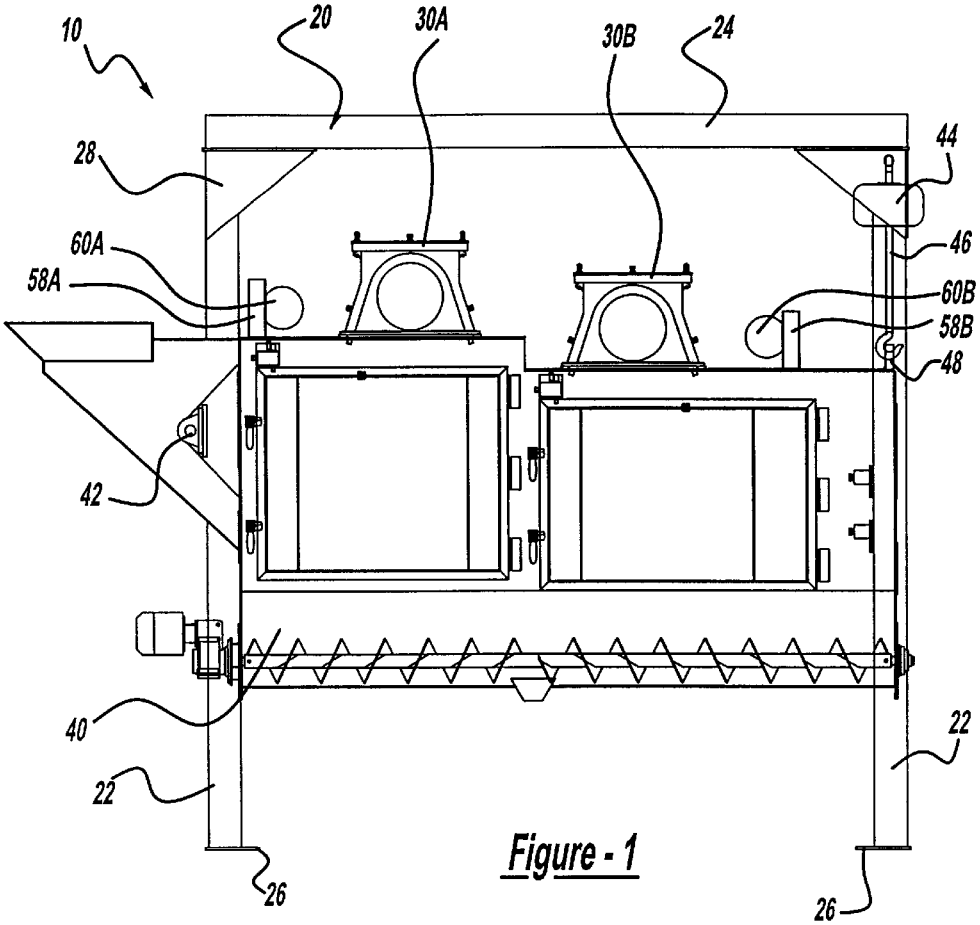
FIG. 1 is a side elevation of the shot blast machine according to the present invention.

The shot blast machine 10 of the present invention is shown in FIG. 1. The shot blast machine 10 includes a frame 20, shot blast wheels 30A and 30B, a cabinet 40, two tumbler sections 50A and 50B, and two guide drums 70A and 70B. Other typical abrasive handling systems, which may be used with the shot blast machine, like a screw conveyor, elevator, separator and abrasive feed, have been omitted for clarity.

As shown in FIG. 1, the frame 20 consists of several vertical beams 22 and horizontal beams 24 for the support of the cabinet 40. The frame 20 further includes feet 26, which allow the frame 20 to be bolted to the floor of a workshop. Preferably, the frame 20 includes vertical beams 22 forming the side edges of a cube and horizontal beams 24 forming the top edges of the cube. Alternately, the frame 20 may include walls instead of vertical beams 22 or any combination of beams and walls. The vertical beams 22 are joined to the horizontal beams 24 with supports 28. The beams 22 and 24, the feet 26, and the supports 28 are made of high strength material, such as steel, and their construction and use would be readily understood by a person of ordinary skill in the shot blast machine arts.

As shown in FIG. 1, the shot blast wheels 30A and 30B, also known as centrifugal throwing wheels, are mounted to the top of the cabinet 40 for impelling abrasive particles towards the tumbler sections 50A and 50B. Preferably, the shot blast machine 10 includes two shot blast wheels 30A and 30B, but may include one or more as deemed necessary for a particular situation. The shot blast wheels 30A and 30B are well known in the machine arts and their implementation in the shot blast machine 10 would be readily understood by a person of ordinary skill in the shot blast machine arts.

The cabinet 40 of the shot blast machine 10 is shown in FIG. 1. The cabinet 40 is pivotally attached to the frame 20 by a pivot joint 42. The pivot joint 42 includes a simple pin and bearing, but may include other devices, such as a hinge. At the other end, the cabinet 40 is also vertically supported by cable 46, which is fastened to a hoist 44 and removably attached to an eyelet 48. The hoist 44, which is mounted to the frame 20, can extend or retract the cable 46 upon manual or automatic activation. In an alternative embodiment, other devices, such as a jack screw or hydraulic cylinder could be employed to raise and lower the cabinet 40 combined with the pivot attachment of the pivot joint 42, allows adjustment of the degree of tilt of the cabinet 40 (and hence the tumbler sections 50A and 50B). This adjustment of the tilt allows substantial control of the duration of the cleaning exposure, as further defined and described below. The pivot joint 42, the hoist 44, the cable 46, and the eyelet 48 are all well known in the machine arts and their implementation in the shot blast machine 10 would be readily understood by a person of ordinary skill in the shot blast machine arts.

Figure 2:
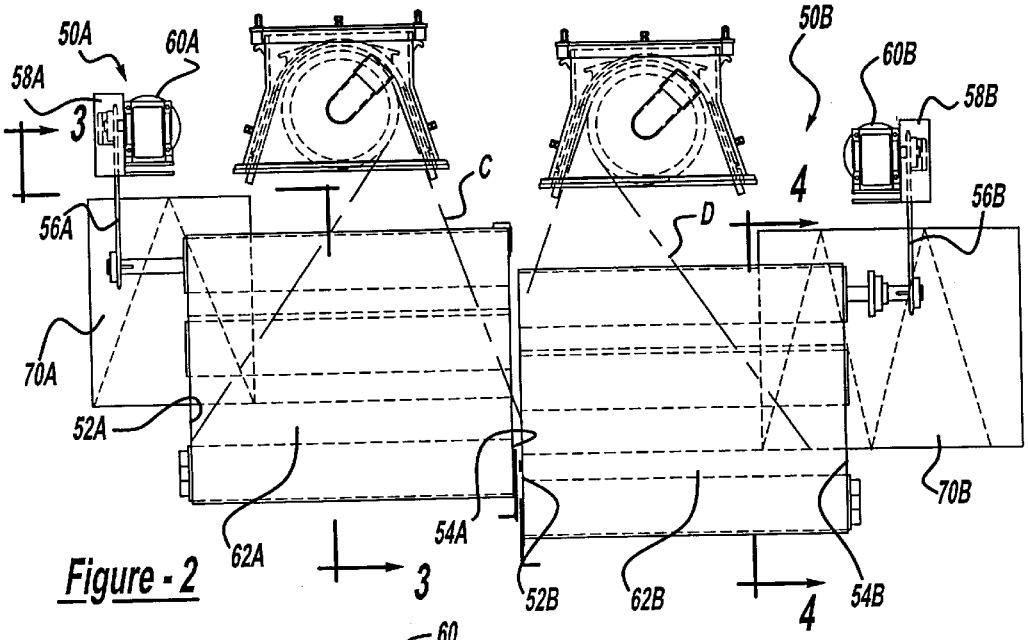
FIG. 2 is a view of the tumbler mechanism in the present invention.

The tumbler sections 50A and 50B are located in the cabinet 40. As shown in FIG. 2, each of the tumbler sections 50A and 50B provides a surface with an ingress 52A and 52B and an egress 54A and 54B for tumbling the workpieces under the path C and D of abrasive particles from the shot blast wheels 30. Each of the tumbler sections 50A and 50B is driven by a drive chain 56A and 56B that is shielded by a guard 58A and 58B and attached to the output of a drive gear box with motor 60A and 60B.

As shown in FIG. 1, gear box 60A is mounted to the top of cabinet 40 near the ingress 52A of tumbler section 50A and gear box 60B is mounted near the egress 54B of tumbler section 50B. This particular arrangement allows the first tumbler section 50A to tumble at a different speed than the second tumbler section 50B. The tumbler sections 50 are abutted to opposite sides of a bulkhead 51 (FIG. 5) and are vertically displaced relative to each other, which forms a step 53 (FIG. 5) to induce an additional tumble of the workpieces as they tumble from the egress 54A of tumbler section 50A to the ingress 52B of tumbler section 50B, as further described below. Preferably, the shot blast machine 10 includes two tumbler sections, but may include more or fewer as deemed necessary for a particular cleaning of workpieces. The drive chains 56A and B, the guards 58A and B, and the drive motors 60 are all well known in the machine arts and their implementation in the shot blast machine 10 would be readily understood by a person of ordinary skill in the shot blast machine arts.

Figure 3:
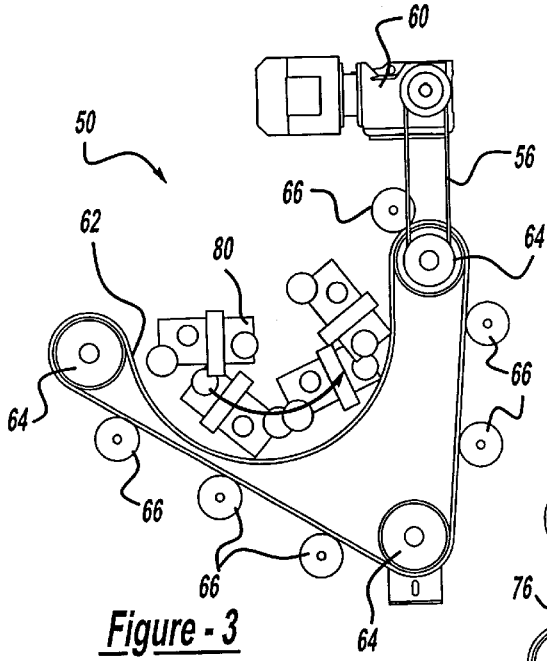
FIG. 3 is a partial cross-sectional view taken along the line 3—3 of FIG. 2.

As shown in FIG. 3, the tumbler sections 50A and B include tumble belts 62, drive rollers or shafts 64 and several support rollers 66. The drive rollers 64 are driven by the drive chains 56. Further, two more rollers 65 engage the guide drum 70 which cooperates with the shafts 64 and 65 to form a generally U-shaped cross-section of the tumble belt 62. This U-shaped configuration allows the tumble belt 62 to first cradle the workpieces under the path of abrasive particles and then flip the workpieces to a new orientation as the tumble belt 62 traverses around the rollers 64 and 65. As shown in FIG. 2, the rollers 64 and 65 contact the tumble belt 62 along the entire width, from the ingress 52 to the egress 54, of the tumble belt 62. The rollers 66 can also be provided to support the tumble belt 62, but from the exterior of the tumble belt 62. This support substantially prevents any belt slack that may negatively affect the contour of the belt 62 on its cantilevered end. The tumble belt 62 is preferably made of a rubber material and alternately made of any material that can traverse through a U-shaped rotation and that can withstand the abrasive articles from the shot blast wheels 30.

Figure 4:
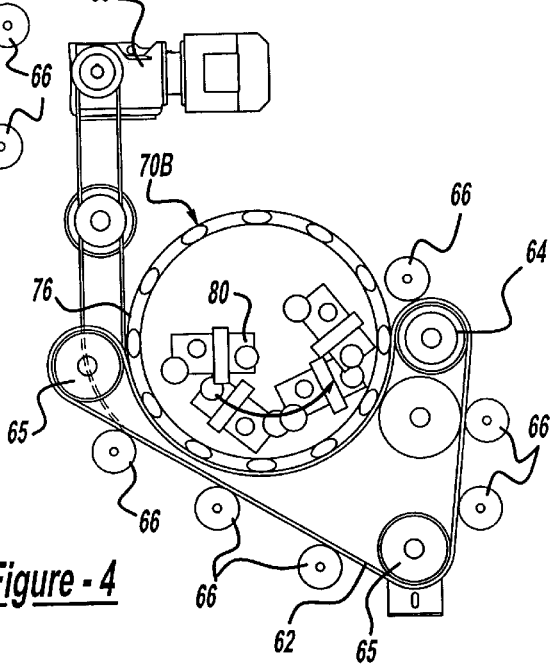
FIG. 4 is a partial cross-sectional view taken along the line 4—4 of FIG. 2.

As shown in FIGS. 2 and 4, the guide drum 70A is located at the ingress 52A of the first tumbler section 50A and feeds workpieces 80 to the first tumbler section 50A. The other guide drum 70B is located at the egress 54B of the second tumbler section 50B which receives workpieces 80 from the first tumbler section 50A.

Figure 5:
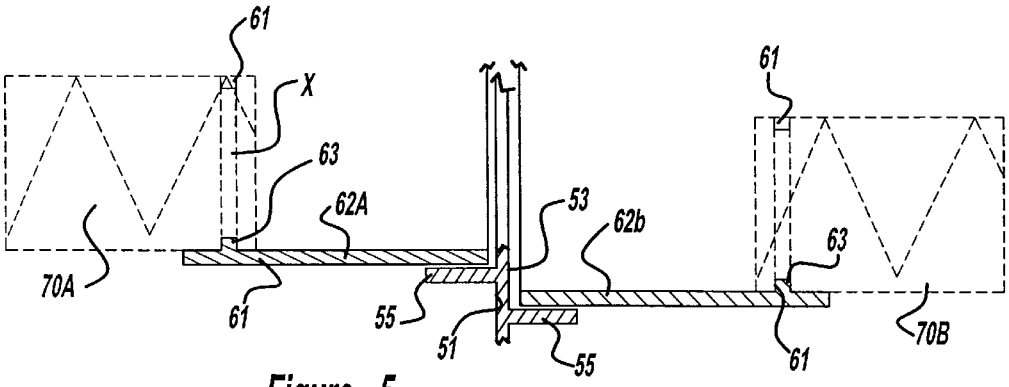
FIG. 5 is a combination elevational and sectional view of the machine of this invention to show the relationship of the tumbler belts that support and tumble the workpieces and the shaping drums that maintain a cantilever relationship with the belts.

The guide drums 70 contact the tumbler belts 62 between two shafts 64 and 65. The guide drums 70 contact only one end portion of each of the tumbler belts 62. However, the drums 70 contact enough of the belts 62 to shape the belts 62 and maintain a cantilever relationship with the belts 62 which are also supported at their free ends on flanges 55 on the bulkhead 51, as shown in FIG. 5. Radially inward directed annular projections 63 on the belts 62 travel in locator grooves 61 in the outer surface of the drums 70 so as to maintain the drum-belt relationship The drums 70 may include interior conveyor screw sections to deliver and retrieve the workpieces from and to the tumbler belts 62. The guide drums 70 may be supported by rollers (not shown).

Before using the shot blast machine 10, the size, shape, and weight of the workpieces, the size of any uneven surfaces in the workpieces, and the type of surface debris, are all considered to determine the speed of the tumble belts 62 and the tilt of the cabinet 40. Both the speed of the tumble belts 62 and the tilt of the cabinet 40 are adjusted with simple controllers (not shown), which are known and used in the machine arts. The tumble belt controller adjusts the revolutions per minute of the output from the drive motors 60, while the cabinet tilt controller adjusts the vertical extension or retraction of the cable 46 by the hoist 44. With these two controllers, the duration of the cleaning process—as defined by the time for the workpieces to tumble from the ingress 52A of the first tumbler section 50A to the egress 54B of the second tumbler section 50B—may be substantially controlled. This feature of the present invention increases the efficiency of the shot blast machine 10.

After the determination of the speed of the tumbler sections 50 and the tilt of the cabinet 40, the workpieces 80 are inserted into the first guide drum 70A. Workpieces 80 may consist of engine components, or any other article, that need sand, scale or other debris removed from their surface. As the guide drum and tumble belt 62 move, the workpieces 80 tumble in a helical or spiral pattern along the length of the tumbler sections 50. When the workpieces 80 tumble from the egress 54A of the first tumbler section 50A to the ingress 52B of the second tumbler section 50B, the workpieces undergo an additional tumble. Further, the first tumbler section 50A and the second tumbler section 50B are rotated in opposite directions. These features of the present invention increase the quality and the efficiency of the entire cleaning process by encouraging the shot blasting of every surface on the workpieces 80 in a timely manner. When the workpieces 80 tumble to the egress 54B of the second tumbler section 50B and into the second guide drum 70B, the cleaning cycle is complete.

The foregoing discussion discloses and describes a preferred embodiment of the present invention. One skilled in the art will readily recognize from such discussion, and from the accompanying drawings and claims, that changes and modifications can be made to the invention without departing from the true spirit and fair scope of the invention as defined in the following claims.

We claim:

1. A shot blast machine for cleaning workpieces, comprising:

a frame;

a device mounted to said frame for impelling abrasive particles;

a first tumbler secured to said frame and having a first surface with an ingress and an egress for tumbling the workpieces in the path of said abrasive particles; and a second tumbler secured to said frame adjacent said first tumbler and having a second surface positioned significantly below said first level so as to receive workpieces exiting from said first surface and falling at the egress of said first surface onto the second surface at the ingress thereof, so as to further tumble said workpieces as a consequence of falling from said first tumbler to said second tumbler, said second tumbler having an ingress and an egress for even further tumbling the workpieces in a different direction as they are emerging from the first tumbler in the path of said abrasive particles;

wherein said first and second surfaces form a downward step located at said egress of said first surface and at said ingress of said second surface to induce an additional tumble of the workpieces as they tumble from said egress of said first surface to said ingress of said second surface.

2. A shot blast machine for cleaning workpieces. comprising:

a frame;

a device mounted to said frame for impelling abrasive particles;

a first tumbler secured to said frame and having a first surface with an ingress and an egress for tumbling the workpieces in the path of said abrasive particles; and a second tumbler secured to said frame adjacent said first tumbler and having a second surface with an ingress and an egress for tumbling the workpieces in the path of said abrasive particles;

wherein said first and second surfaces form a step from said egress of said first surface to said ingress of said second surface to induce an additional tumble of the workpieces as they tumble from said egress of said first surface to said ingress of said second surface; and two independent tumbler belts, rotating (moving) in opposite direction to each other, creating enhanced exposure of workpieces to the abrasive particles.

3. A shot blast machine for cleaning workpieces, comprising:

a frame;

a device mounted to said frame for impelling abrasive particles;

a first tumbler secured to said frame and having a first continuous belt with an ingress, an egress, and a predetermined width for tumbling the workpieces in the path of said abrasive particles, drive roller means for contacting said first continuous belt, and a first guide drum in a cantilever relation with said belt and operable to shape said belt to form a generally U-shaped cross-section of said first continuous belt and to thereby enable said first continuous belt to support the workpieces; said belt and said drum having interengaging tongue and groove engagement and overlapping the drum substantially so that the tumbling belt can be cantilevered from the drum, and a second tumbler secured to said frame adjacent said first tumbler and having a second continuous belt with an ingress, an egress, and a predetermined width for tumbling the workpieces in the path of said abrasive particles, drive shaft means for contacting said second continuous belt, and a second guide drum to form a generally U-shaped cross-section of said second continuous belt and to thereby enable said second continuous belt to support the workpieces;

wherein said first and second continuous belts form a step from said egress of said first continuous belt to said ingress of said second continuous belt to induce an additional tumble of the workpieces in another plane as they tumble from said egress of said first continuous belt to said ingress of said second continuous belt.

4. A shot blast machine for cleaning workpieces, comprising:

a frame;

a device mounted to said frame for impelling abrasive particles;

a first tumbler secured to said frame and having a first continuous belt with an ingress, an egress, and a predetermined width for tumbling the workpieces in the path of said abrasive particles, drive roller means for contacting said first continuous belt, and a first guide drum in a cantilever relation with said belt and operable to shape said belt to form a generally U-shaped cross-section of said first continuous belt and to thereby enable said first continuous belt to support the workpieces; and a second tumbler secured to said frame adjacent said first tumbler and having a second continuous belt with an ingress, an egress, and a predetermined width for tumbling the workpieces in the path of said abrasive particles, drive shaft means for contacting said second continuous belt, and a second guide drum to form a generally U-shaped cross-section of said second continuous belt and to thereby enable said second continuous belt to support the workpieces;

wherein said first and second continuous belts form a step from said egress of said first continuous belt to said ingress of said second continuous belt to induce an additional tumble of the workpieces in another plane as they tumble from said egress of said first continuous belt to said ingress of said second continuous belt, each of said first and second continuous belts being tiltable, the degree of tilt of said first and second continuous belts being adjustable to substantially control the speed of the workpieces tumbling from said ingress of said first continuous belt to said egress of said second continuous belt.

* * * * *